United States Patent [19]

Hornung

[11] 4,047,835

[45] Sept. 13, 1977

[54] HIGH EFFICIENCY PROPELLER

[76] Inventor: Arthur Charles Hornung, 3143 8th St., Boulder, Colo. 80302

[21] Appl. No.: 710,910

[22] Filed: Aug. 2, 1976

[51] Int. Cl.[2] ..... B63H 1/28

[52] U.S. Cl. ..... 416/23; 416/236 A

[58] Field of Search ..... 416/23, 24, 236, 236 A

[56] References Cited

U.S. PATENT DOCUMENTS

| | | | |
|---|---|---|---|
| 1,446,011 | 2/1923 | Jackson | 416/236 A |
| 1,537,401 | 5/1925 | Blumschein | 416/236 A X |
| 2,099,229 | 11/1937 | Possenheim | 416/236 A |
| 2,359,466 | 10/1944 | Currie | 416/236 A X |
| 2,498,170 | 2/1950 | Meier | 416/236 A |
| 3,275,082 | 9/1966 | Stark | 416/236 X |
| 3,294,175 | 12/1966 | Bodner | 416/236 X |
| 3,812,812 | 5/1974 | Hurwitz | 416/23 X |

FOREIGN PATENT DOCUMENTS

| | | | |
|---|---|---|---|
| 802,966 | 9/1936 | France | 416/236 A |

*Primary Examiner*—Everette A. Powell, Jr.

*Attorney, Agent, or Firm*—Marden S. Gordon

[57] ABSTRACT

Conventional propeller blades, for use on water or aircraft, provided with a series of foldable fins on the rear surface of each propeller blade, a number of rows of fins being affixed along the length of each propeller blade and with each row of fins being tapered in height so as to be taller in height at the leading edge of each propeller blade and tapering to a small height at the trailing edge of each propeller blade, with the foldable fins projecting into a fully extended position when the propeller blades turn in a counter clockwise direction as when a vehicle is propelled forwardly and folding into a retracted position when the propeller blades turn in a clockwise direction as when a vessel is urged in a rearwardly direction. When a vessel is moved forwardly with the foldable fins in an extended position, the fins prevent the propellant medium, namely water or air from slipping along the length of the propeller blades and going off the ends. The fins direct the propellant rearwardly and thrust the vessel ahead, thereby significantly increasing the efficiency of a propeller.

5 Claims, 4 Drawing Figures

HIGH EFFICIENCY PROPELLER

BACKGROUND OF THE INVENTION

1. Field of the Invention

This invention relates to a high efficiency propeller providing additional surface contact in water or air to increase the propelling force of a propeller by directing the propellant rearwardly and keeping the propellant from slipping along the length and off the ends of propeller blades.

2. Description of the Prior Art

A vital concern in today's economy is the conservation of energy. The use of water or air vessels for recreational and commercial purposes is continually increasing and represents a major factor in the utilization of energy resources. Many devices have been described in an attempt to increase propeller efficiency, such as U.S. Pat. No. 3,554,665 issued to Lorenz et al. Jan. 12, 1971 relating to a flow through propeller, U.S. Pat. No. 2,382,431 issued to Loth et al. Aug. 14, 1945 describing a swivelling screw propeller, and U.S. Pat. No. 508,324 issued to Leisen Nov. 7, 1893 illustrating a screw type propeller, plus other devices describing such solutions as jet propulsion, nuclear energy driven systems, and the like, but all of these are generally impractical for various reasons, particularly due to their complexity and high manufacturing costs, whereas nothing is described to maximize the efficiency of a conventional type propeller which has been shown to be the most practical means in most cases for propelling most water vessels and certain types of aircraft, particularly a helicopter. There is, then, an obvious need in the marketplace for a simple but effective technique for increasing the efficiency and utilization of conventional propeller blades.

SUMMARY OF THE INVENTION

The present invention provides a high efficiency propeller for increasing the utilization of a propellant medium, namely water or air.

It is a feature of the present invention to provide a high efficiency propeller.

A further feature of the present invention provides a high efficiency propeller which is reliable and efficient in operation.

Yet still a further feature of the present invention provides a high efficiency propeller which is of a rugged and durable construction and which, therefore, may be guaranteed by the manufacturer to withstand rough and continual usage.

An additional feature of the present invention provides a high efficiency propeller which is simple in construction and which, therefore, may be produced by a manufacturer at an economical cost so as to encourage widespread usage thereof.

Other features of this invention will be apparent during the course of the following description.

BRIEF DESCRIPTION OF THE DRAWINGS

In the accompanying drawings forming a part of this specification, and in which like reference characters are employed to designate like parts throughout the same.

DESCRIPTION OF THE PREFERRED EMBODIMENT

Figure 1:
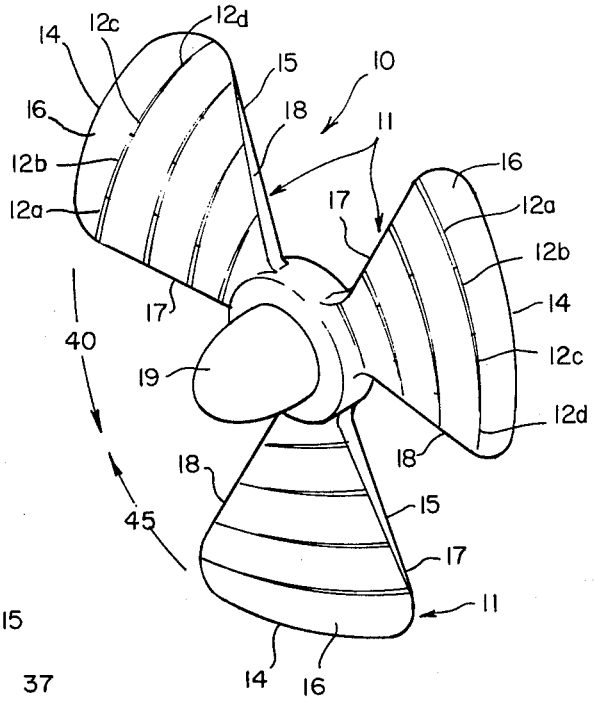
FIG. 1 is a perspective view of rows of foldable fins affixed to the rear surface of a propeller.
Figure 2:
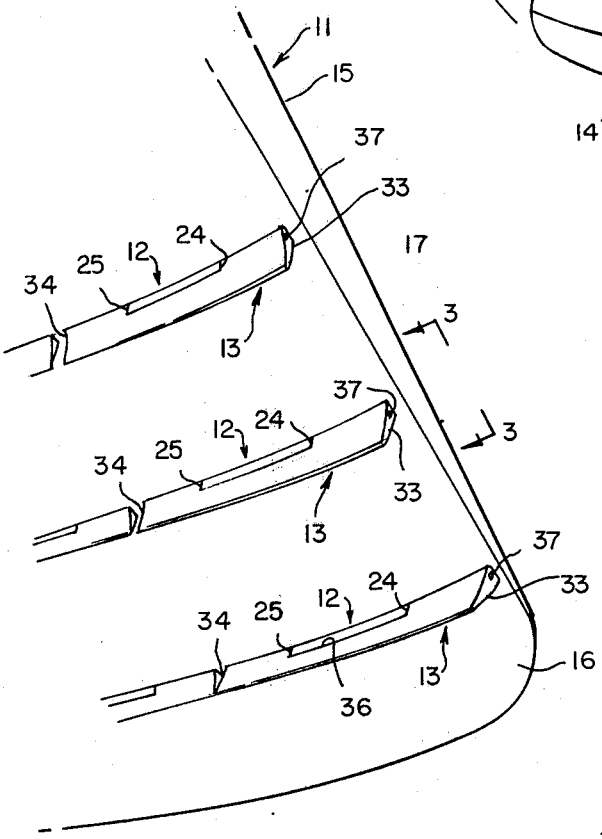
FIG. 2 is a partial perspective view of the foldable fins in an extended position.

Referring now to the drawings in detail, there is illustrated a preferred form of the high efficiency propeller constructed in accordance with the principles of the present invention and which is designated generally in its entirety by the reference numeral 10 and which is comprised of a series of conventional propeller blades 11, a series of flanges 12, a series of foldable fins 13, and associated configurations and interconnecting components as will be later described.

The propeller blades 11 can be any conventional type propeller blades as used on water or air vessels and generally consisting of a rounded outside surface 14, a front surface 15 and an opposed rear surface 16, tapered side surfaces 17 and 18 with each angled inwardly and obliquely from the outside surface 14 to be joined in a conventional manner at their inside surface equidistantly spaced around a circular hub.

The flanges 12 are integrally formed with the rear surface 16 of the propeller blades 11, such as by being integrally cast therewith during the same manufacturing process, and consist of an inside surface 20 where they are integrally conjoined with the rear surface 16 and an opposed outside surface 21, opposed side surfaces 22 and 23, and opposed end surfaces 24 and 25, with a series of flanges 12 being spaced apart, as shown in the drawings, in line laterally across the width of the rear surface 16 between the side surfaces 17 and 18 respectively and longitudinally in line on the rear surface 16 between the outside surface 14 and the hub 19. A round through hole 26 is further provided in each flange 12 running axially between the end surfaces 24 and 25 and disposed approximately centrally therethrough.

The foldable fins 13 are constructed of the same or similar material as the propeller blades 11 and consist of a flat bottom surface 27 which is rounded as shown by the reference numeral 28 on the end facing away from the direction of the outside surface 14 and blunt on the opposite end as shown by the reference numeral 29, semi-curved side surfaces 30 and 31 to form a narrow top surface 32 interconnecting on each end the opposed end surfaces 33 and 34 with the top surface 32 being tapered downwardly as it extends from the end surface 33 toward the end surface 34 so that the end surface 33 is taller in height than the end surface 34. Each of the foldable fins 13 is further provided with a round through hole 35 extending axially between the end surfaces 33 and 34 and disposed near the rounded edge 28, with each of the foldable fins 13 being further provided with a rectangular groove 36 disposed centrally along the bottom surface 27 and provided with dimensions to fit over the flanges 12 with the round through hole 35 axially lining up with the round through hole 26 by which the foldable fins 13 are assembled to the flanges 12 in a pivotal manner by means of a pin 37 extending through the through holes 35 and 26 respectively. The series of flanges 12 extending laterally on the rear surface 16 of each propeller blade 11 is designed so that the top surface 32 is uniformly tapered downwardly toward the rear surface 16 as the top surface 32 extends from the leading side surface 17 toward the trailing side surface 18 so that, as shown in FIG. 1, the flange 12*a* projects further from the rear surface 16 than flange 12*b*, 12*b* extends further than the flange 12*c*, etc., with the end surface 34 of the flange adjacent the side surface 18 being smallest in height.

Figure 3:
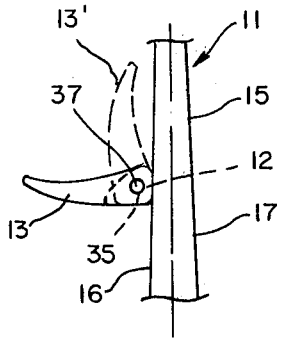
FIG. 3 is a side elevational view showing a fin in an extended versus a retracted position.
Figure 4:
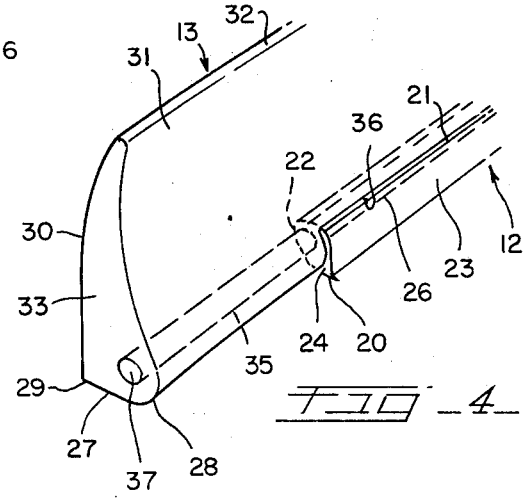
FIG. 4 is a partial sectional view showing the hinge mechanism for a foldable fin.

In operation, the propeller blades 11 would turn in a counter clockwise direction as shown by the arrow 40 to propel a water or air vessel in a forward direction, the force of water or air on the foldable fins 13 causing them to project from the rear surface 16 in a pivotal manner over the flanges 12 by means of the pin 37 assembled through the through holes 35 in the fins 13 and the through holes 26 in the flanges 12, with the blunt corner 29 on the bottom surface 27 of the fins 13 causing the fins 13 to extend approximately perpendicularly to the rear surface 16 of the propeller blades 11, so that, as the propeller blades 11 are turning in a counter clockwise direction, as shown by the arrow 40, the turbulence of the water or air is less and the propeller is more efficient due to the added surface contact provided by the foldable fins 13 and the rear surface 16. When the propeller blades 11 turn in a clockwise direction as shown by the arrow 45, the water or air is churned against the backside surface 30 of the foldable fins 13 to thereby cause the foldable fins 13 to fold inwardly toward the rear surface 16 as shown by the reference numeral 13' in FIG. 3 so as to have little or no effect on the efficiency of the propeller blades 11 when a vessel is being urged in a backward direction. Foldable fins 13 could be provided on the front surface 15 of the propeller blades 11 similarly as shown on the rear surface 16 to increase the efficiency of the propeller blades 11 when a vessel is being urged in a backward direction; this is not shown, however, since a vessel would normally back up an insignificant percentage of the time.

It is to be understood that the form of this invention as shown and described is to be taken as a preferred example thereof, and that this invention is not to be limited to the exact arrangement of parts described in the description or illustrated in the drawings as changes thereto in the details thereof pertaining to size, shape and arrangement of parts thereof are envisioned within the scope of the invention without departing from the novel concepts of the invention. For example, instead of providing hinged or foldable fins on the rear surface of a propeller, fixed fins could be provided with the entire fin structure manufactured as an integral part of the propeller blade.

Having thus described the invention, what is claimed is:

1. A high efficiency propeller which provides added surface contact with a propellant medium, namely water or air, which is prevented from slipping off of the ends of the propeller, thereby increasing the efficiency of the propelling force of a propeller, the device comprising, in combination:

conventional propeller blades;

a series of flanges integrally formed with the outside surface of the propeller blades, consisting of an inside surface integrally conjoined with the rear surface of said propeller blades, an outside surface, opposed side surfaces, and opposed end surfaces, with a series of flanges spaced apart in line laterally across the width of said rear surface and between said side surfaces respectively and longitudinally in line on said rear surface between said outside surface and the hub of a propeller, with further a round through hole provided in each flange running axially between said end surfaces and disposed approximately centrally therethrough; and a series of foldable fins constructed of the same material as said propeller blades and consisting of a flat bottom surface rounded on one of its ends and blunt on the opposite end, semi-curved side surfaces, and a narrow top surface interconnecting on each end the opposed end surfaces with said top surface being tapered downwardly as it extends from the leading edge of a propeller blade to the trailing edge of a propeller blade, with each of said foldable fins further provided with a round through hole extending axially between said end surfaces and disposed near said rounded edge, and with each of said foldable fins being further provided with a rectangular groove disposed centrally along its bottom surface and provided with dimensions to fit over said flanges so that said round through hole in said foldable fins axially line up with said round through hole in said flanges with said foldable fins and said flanges connected thereby in a pivotal manner by means of a pin.

2. A high efficiency propeller as set forth in claim 1 wherein a series of said flanges extending laterally on said rear surface of each propeller blade is designed so that the respective top surfaces of each flange are uniformly tapered downwardly toward said rear surface of said propeller blade as said top surface extends from said leading edge of a propeller blade toward the trailing side surface of a propeller blade, with the end surface of the flange adjacent the trailing side surface of a propeller blade being smallest in height.

3. A high efficiency propeller as set forth in claim 1 wherein said foldable fins are forced outwardly from said rear surface of said propeller blades when said propeller blades turn in a counter clockwise direction when urging a vessel forwardly, and where further said foldable fins are folded inwardly toward the rear surface of said propeller blades when said propeller blades turn in a clockwise direction when urging a vessel in a backward direction.

4. A high efficiency propeller as set forth in claim 1 wherein said foldable fins are provided on the front surface of propeller blades to increase propeller efficiency when a vessel is urged in a backward direction.

5. A high efficiency propeller as set forth in claim 1 wherein a series of fins are provided on propeller blades so as to provide added surface contact of said propeller blades with water or air and to thereby increase the efficiency or propelling force of a propeller, by directing it totally rearwardly rather than partially outwardly.

* * * * *